US006992544B2

(12) United States Patent
Barnes et al.

(10) Patent No.: US 6,992,544 B2
(45) Date of Patent: Jan. 31, 2006

(54) SHIELDED SURFACE MOUNT COAXIAL CONNECTOR

(75) Inventors: Heidi L. Barnes, Forestville, CA (US); Andrew N. Smith, Healdsburg, CA (US); Floyd A. Bishop, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 132 days.

(21) Appl. No.: 10/269,710

(22) Filed: Oct. 10, 2002

(65) Prior Publication Data

US 2003/0052755 A1 Mar. 20, 2003

(51) Int. Cl.
*H01P 1/04* (2006.01)
*H01P 5/02* (2006.01)

(52) U.S. Cl. ..... 333/33; 333/34; 333/260; 439/581

(58) Field of Classification Search ..... 333/34, 333/33, 260; 439/581
See application file for complete search history.

(56) References Cited

U.S. PATENT DOCUMENTS

| | | | | |
|---|---|---|---|---|
| 3,201,722 | A | 8/1965 | May et al. | 333/260 X |
| 4,346,355 | A | 8/1982 | Tsukii | 333/260 X |
| 4,645,288 | A | 2/1987 | Stursa | |
| 4,995,815 | A | 2/1991 | Buchanan et al. | 333/260 X |
| 5,190,474 | A | 3/1993 | Ginet | |
| 5,570,068 | A | 10/1996 | Quan | 333/260 X |
| 5,860,812 | A | 1/1999 | Gugliotti | |
| 5,879,188 | A | 3/1999 | Clyatt | |
| 5,899,754 | A | 5/1999 | Beloritsky et al. | |
| 6,166,615 | A | 12/2000 | Winslow et al. | 333/260 |
| 6,236,287 | B1 * | 5/2001 | Quan et al. | 333/33 |
| 6,700,464 | B2 | 3/2004 | Ling et al. | 333/260 |

* cited by examiner

*Primary Examiner*—Benny Lee

(57) ABSTRACT

A coaxial connection is electromagnetically shielded at an interface between a surface mountable coaxial connector and a planar circuit operating in the radio frequency (RF) and microwave frequency ranges. In addition or alternatively, the coaxial connection reduces a potential impedance mismatch associated with attaching a coaxial transmission line of the coaxial connector to a planar transmission line of the planar circuit.

36 Claims, 8 Drawing Sheets

SHIELDED SURFACE MOUNT COAXIAL CONNECTOR

TECHNICAL FIELD

The invention relates to radio frequency (RF) and microwave circuits and systems. In particular, the invention relates to coaxial connectors used with planar circuits operating at RF and microwave frequencies.

BACKGROUND ART

High frequency devices, circuits and subsystems, such as those operating at radio frequency (RF) and microwave frequency ranges, are often manufactured as or using a planar circuit. The planar circuits, typically referred to as 'printed circuit boards' (PCBs), frequently are interconnected with one another using coaxial cables. Coaxial connectors at an interface between a PCB and the coaxial cable enable the individual PCB to be connected and disconnected during assembly and/or test, as well as for maintenance and replacement purposes once the PCB has been deployed. A variety of classes or series of standard and semi-custom coaxial connectors are readily available and in widespread use including, but not limited to, SMA, SMB, SMC, SSMA, 3.5-mm, and 2.4-mm, 1.85-mm connectors. In general, each of the various coaxial connector series is available in a variety of styles, each style being adapted to a particular application and/or circuit-mounting configuration.

Among the coaxial connector styles used in conjunction with high frequency PCBs are surface-mountable styles often referred to as 'surface mount' (SMT) connectors. FIG. 1A illustrates a perspective view of a typical, conventional SMT coaxial connector 10 that emphasizes an end (hereinafter the end view is referred to as being 'top-oriented'). FIG. 1B illustrates a perspective view of the SMT connector 10 of FIG. 1A that emphasizes an opposite end (hereinafter the opposite end view is referred to as being 'bottom-oriented'). FIG. 2 illustrates a cross sectional view of the conventional SMT connector 10 of FIG. 1A attached to a PCB 11, the connector 10 being interfaced with a microstrip transmission line 24 on the PCB 11.

The conventional SMT connector 10 illustrated in FIGS. 1A, 1B and 2 comprises a connector shell or barrel 12, a connector base 14, a center pin 16, and a dielectric pin support 18. The base 14, connected to a first end 12*a* of the shell 12, comprises a flange 20 and a plurality of spacer legs or stand-offs 22. The center pin 16 is mounted in and extends a length of a through hole of the shell 12. The shell through hole runs axially through the shell 12 and through the flange 20 from a second or connector end 12*b* of the shell 12 to an outer surface 19 of the flange 20. The center pin 16 is supported in the through hole by the dielectric pin support 18. Together, the through hole through the shell 12 and the flange 20 along with the center pin 16 therethrough form a coaxial transmission line. The center pin 16 extends axially beyond the outer surface 19 of the flange 20 a distance equivalent to a length of the spacer legs 22. Typically, the connector 10 is interfaced to the PCB 11 by soldering a connection end 16*a* of the center pin 16 to a transmission line 24 of the PCB 11 and soldering or otherwise electrically connecting the spacer legs 22 to a ground plane 28 of the PCB 11.

The presence of the spacer legs 22 creates a gap 30 between the outer surface 19 of the flange 20 and a top surface of the PCB 1. The gap 30 enables a solder joint 26 at the connection end 16*a* of the center pin 16 to be cleaned and inspected during manufacturing. In addition, the gap 30 insures that expansion of the dielectric pin support 18 during solder reflow will not interfere with proper solder attachment of the center pin 16. In particular, the gap 30 accommodates any expansion of the dielectric pin support 18 such that the connector 10 does not lift off of the PCB 11 surface during soldering.

Unfortunately, the presence of the gap 30 results in a signal path discontinuity experienced by a signal traveling between the connector 10 and the transmission line 24 of the PCB 11. In particular, the signal path discontinuity exists in the SMT connector 10 transmission line between the outer surface 19 of the flange 20 and the PCB 11 surface where the center pin 16 is attached to the transmission line 24 of the PCB 11. In addition, a solder joint or fillet 26 formed when the center pin 16 is soldered to the transmission line 24 tends to exacerbate the discontinuity associated with the gap 30.

Ultimately, the discontinuity associated with the gap 30 and solder fillet 26 leads to unwanted or spurious electromagnetic radiation (EM) from the interface between the connector 10 and the PCB 11. In addition, the discontinuity associated with the gap 30 and solder fillet 26 manifests itself as an impedance mismatch, thereby introducing unwanted signal reflections in the signal path passing through the connector 10 and to the PCB 11. The signal reflections can and often do interfere with a performance of a device or system that employs conventional SMT connectors.

Accordingly, it would be advantageous to have an SMT connector that minimized spurious EM radiation and minimized a signal path discontinuity and associated impedance mismatch associated with interfacing the SMT connector to a PCB. Such a coaxial connector would address a longstanding need in the area of surface-mountable connectors for RF and microwave applications.

SUMMARY OF THE INVENTION

The present invention provides a shielded, coaxial connector interface for planar circuits operating in the radio frequency (RF) and microwave frequency ranges. In particular, a shielded, surface-mountable (SMT), coaxial connector, a system for removably connecting and a method of interfacing for RF and microwave circuit and device applications are provided. The shielded SMT coaxial connector connection electromagnetically shields an interface between the connector and a planar circuit, such as a printed circuit board (PCB), to which the connector is attached. In addition to providing a shielded interface, the present invention also reduces an impedance mismatch associated with attaching the connector to the PCB relative to an impedance mismatch associated with an attachment without the present invention. The present invention is applicable to a wide variety of standard and semi-custom connector classes including, but not limited to SMA, SMB, SMC, 3.5-mm, 2.4-mm, 1.85-mm, and 1.0-mm series connectors.

In an aspect of the present invention, a surface-mountable (SMT) coaxial connector is provided. The SMT coaxial connector comprises an electromagnetic shield that shields an interface created between the coaxial connector and a planar circuit when the connector is attached to the planar circuit. The shield comprises a mounting end of the connector that is annular in shape and coplanar with a connection end of a coaxial transmission line of the connector. The coplanar mounting end and the connection end of the transmission line are adjacent to the interface. Depending on the embodiment, the coaxial connector of the present invention either alternatively comprises or additionally comprises an impedance mismatch reducer that reduces an impedance mismatch between the coaxial transmission line and a transmission line of the planar circuit at the interface. The coaxial transmission line is an air dielectric transmission line or air-line at and adjacent to the interface. The impedance mismatch reducer comprises an accommodation for a fillet of conductive attachment material used to attach the air-line to the planar circuit, such that an overall diameter of the airline remains constant.

In other aspects of the present invention, a system for removably connecting to an RF or microwave device is provided. The system comprises the surface mountable coaxial connector of the present invention, and further comprises a multilayer planar circuit and a mounting footprint on an exposed surface of the multilayer planar circuit that is adapted to accept the coaxial connector. Moreover, a method of interfacing a coaxial connector to a printed circuit board is provided. The method comprises electromagnetically shielding a coaxial transmission line at an interface created between a coaxial connector and a printed circuit board when the connector is attached to the printed circuit board. The method further comprises accommodating a fillet of conductive attachment material within a mean diameter of the coaxial transmission line. Advantageously, the shielding provided by the SMT connector according to the present invention reduces spurious electromagnetic radiation from the interface between the connector and PCB. Additionally, the present invention reduces an impedance discontinuity at the interface, the discontinuity being association with connector attachment. Certain embodiments of the present invention have other advantages in addition to and in lieu of the advantages described hereinabove. These and other features and advantages of the invention are detailed below with reference to the following drawings.

BRIEF DESCRIPTION OF THE DRAWINGS

The various features and advantages of the present invention may be more readily understood with reference to the following detailed description taken in conjunction with the accompanying drawings, where like reference numerals designate like structural elements in the different drawing figures, and in which.

DETAILED DESCRIPTION

Figure 1A:
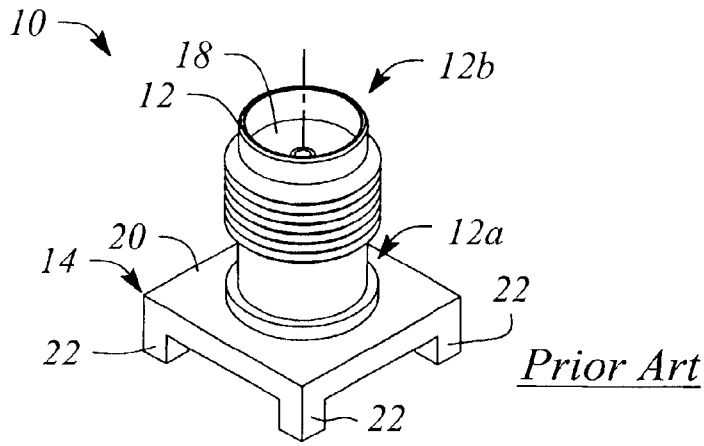
FIG. 1A illustrates a perspective end view of a typical, conventional surface-mountable (SMT), coaxial connector.
Figure 1B:
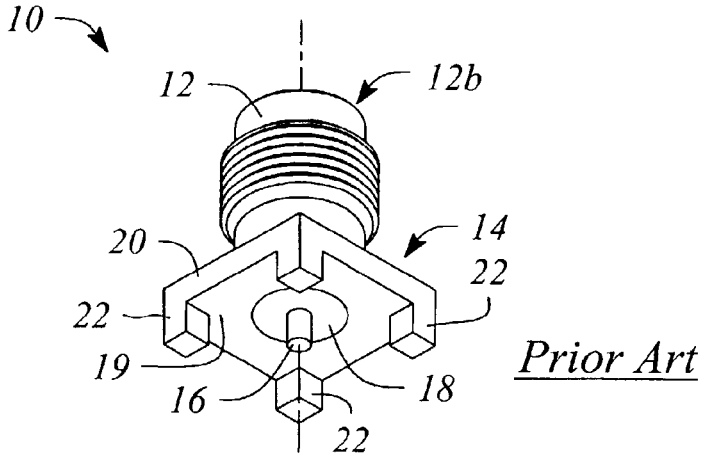
FIG. 1B illustrates a perspective end view of the SMT connector illustrated in FIG. 1A from an opposite end.
Figure 2:
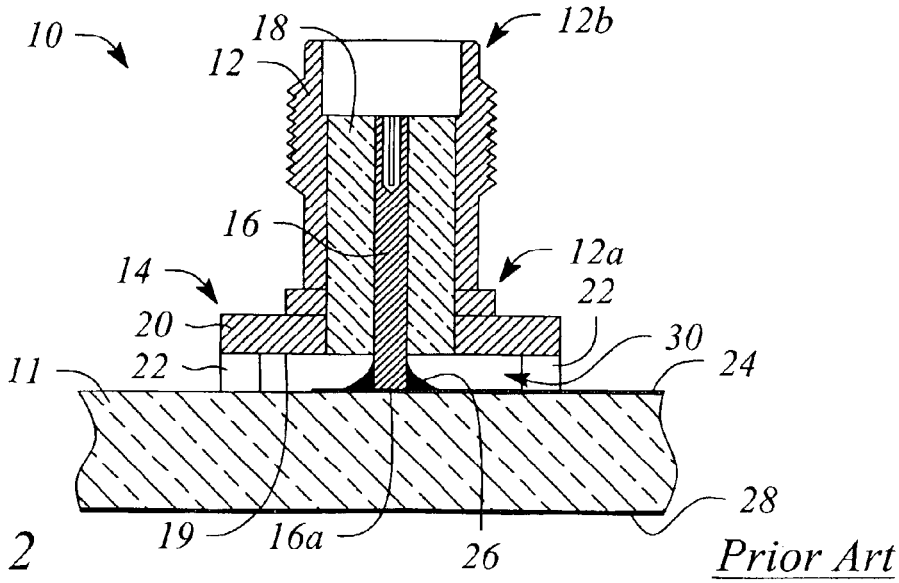
FIG. 2 illustrates a cross-sectional view of the conventional SMT connector illustrated in FIG. 1A attached to a PCB.
Figure 3A:
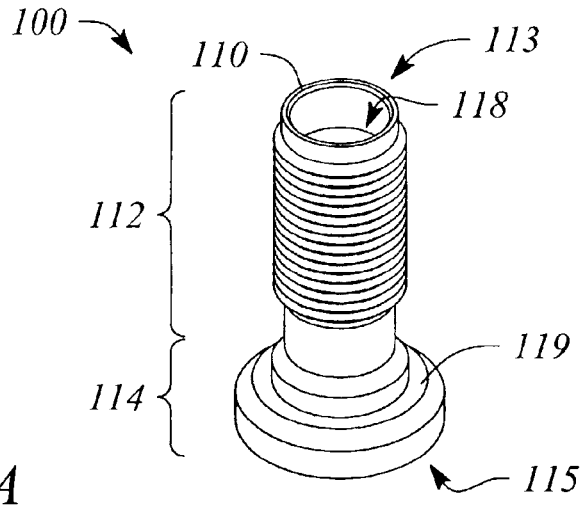
FIG. 3A illustrates a perspective end view of a shielded, surface-mountable (SMT) coaxial connector according to an embodiment of the present invention.
Figure 3B:
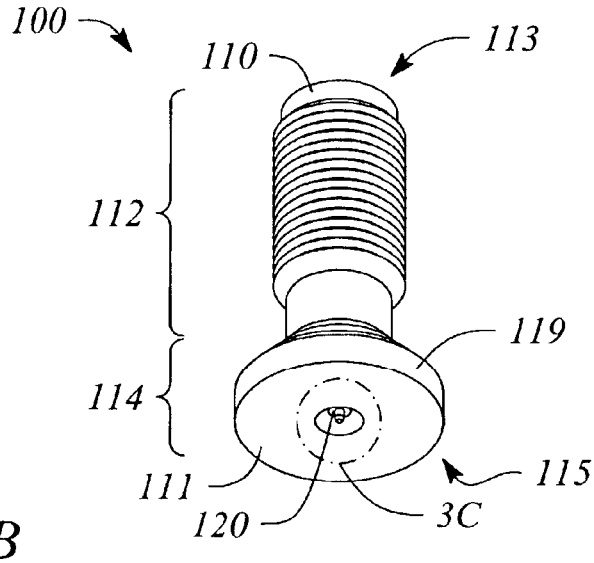
FIG. 3B illustrates a perspective end view of the shielded, surface-mountable (SMT) coaxial connector embodiment illustrated in FIG. 3A from an opposite end.
Figure 3C:
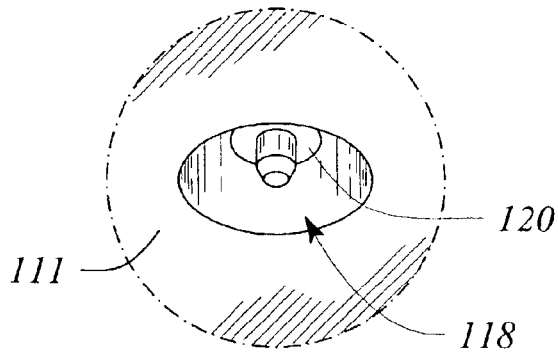
FIG. 3C illustrates a magnified view of a portion of the end view illustrated in FIG. 3B that is within a dashed circle labeled 3C.
Figure 4:
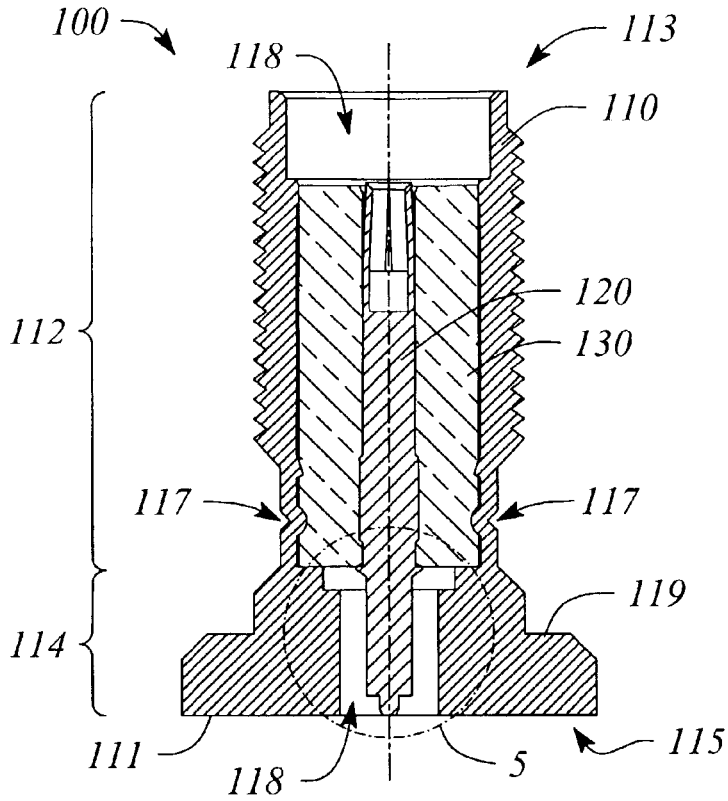
FIG. 4 illustrates a cross-sectional view of an embodiment of a shielded SMT coaxial connector according to the present invention.

FIG. 3A illustrates a perspective end view of a shielded, surface-mountable (SMT) coaxial connector 100 according to an embodiment of the present invention. The end view illustrated in FIG. 3A is referred to as 'top-oriented' herein also. FIG. 3B illustrates a perspective end view of the shielded (SMT) coaxial connector 100 embodiment illustrated in FIG. 3A from an opposite end of the connector 100. The opposite end view illustrated in FIG. 3B is referred to as 'bottom-oriented' herein also. FIG. 3C illustrates a magnified view of a portion of the end view illustrated in FIG. 3B that is within a dashed circle labeled 3C. The view illustrated in FIG. 3C is of a surface 111 of the opposite end of the shielded SMT connector 100. The portion of the surface 111 illustrated in FIG. 3C includes an exit end of a coaxial transmission line of the connector 100. FIG. 4 illustrates a cross-sectional view of an embodiment of the shielded SMT coaxial connector 100 according to the present invention.

The present invention provides a connector interface to a printed circuit board (PCB) or equivalent device realized as a planar circuit for communicating high frequency signals to and from the PCB. In particular, the shielded SMT coaxial connector 100 facilitates removably connecting a coaxial cable or another appropriately 'connectorized' device to the coaxial connector 100. By high frequency, it is meant that the shielded SMT coaxial connector 100 accommodates electromagnetic (EM) signals having frequencies in the radio frequency (RF) and microwave frequency ranges. Moreover according to the present invention, the interface provided is electromagnetically shielded and exhibits an impedance discontinuity associated with the interface that is reduced, and preferably minimized, relative to an interface therebetween without using the present invention.

The shielded SMT coaxial connector 100 comprises an electrically conductive shell 110 having a connector portion 112, and a shield or base portion 114. The connector portion 112 is located adjacent to a mating end 113 of the shell 110. The connector portion 112 is adapted for being removably connected to a mating connector (not illustrated). The mating connector may be on an end of a coaxial cable, such as a semi-rigid coaxial cable, for example. The connector portion 112 is configurable as either a 'female' connector or a 'male' connector according to the present invention. The connector portion 112 is illustrated and represented hereinbelow as a female connector, for discussion purposes only. In particular, the representation of the connector portion 112 according to the present invention as a female connector is not intended to limit the scope of the present invention.

In addition, the connector portion 112 may conform to or be adapted to mate with any standard or non-standard RF or microwave coaxial connector configuration known in the art. For example, the connector portion 112 may conform to any one of the standard microwave coaxial connector configurations or classes including, but not limited to, an SMA connector, a 3.5-mm connector, a 2.4-mm connector, a 1.85-mm connector, a 1.0-mm connector and a 0.6-mm connector. One skilled in the art is familiar with a wide variety of such connector classes in addition to those listed above, all of which are within the scope of the present invention. The skilled artisan may readily realize the connector portion 112 according to the present invention in any of the connector classes known in the art without undue experimentation.

The base portion 114 is located adjacent to a mounting end 115 of the shell 110, the mounting end 115 being distal (i.e., opposite) to the mating end 113. The mounting end 115 provides means for mounting or attaching the coaxial connector 100 to a PCB. In some embodiments, the means for mounting comprises an annular-shaped flange 119, as illustrated in FIGS. 3A and 3B. The annular flange 119 may be soldered, attached with conductive epoxy, or otherwise affixed to a mounting surface or a mounting footprint of the PCB to attach the coaxial connector 100 thereto. Moreover, unlike conventional SMT connectors, the annular flange 119 may be affixed to the PCB all the way around a circumference of the annular flange 119. The entire circumferential attachment of the annular flange 119 contrasts with conventional SMT connectors that employ standoffs or legs as discrete points distributed around a base of the connector for mounting the connector to a PCB.

The shell 110 is tubular having an approximately central through hole 118 that extends through the shell 110 along a longitudinal axis of the shell 110. In particular, the hole 118 extends from the mating end 113 through a length of the connector portion 112 and the base portion 114 to the mounting end 115 of the shell 110. The hole 118 preferably is located at or near a central longitudinal axis of the shell 110 and preferably has a substantially cylindrical shape. Thus, the shell 110 is a hollow tube having an inner surface that is cylindrical and has an inner diameter. The inner diameter of the inner surface of the shell 110 may either vary or be constant along a length of the shell 110.

The shielded SMT coaxial connector 100 further comprises a connector pin 120 and a pin support 130. The connector pin 120 is electrically conductive, and is located in and is coaxial with the hole 118. Preferably, the connector pin 120 is approximately centrally located in the through hole 118, and therefore, the connector pin 120 may be referred to herein as 'enter pin 120' without limiting the scope of the invention to only a centrally located connector pin. Acting together, the shell 110 and the center pin 120 function as a high frequency, coaxial waveguide or transmission line that supports electromagnetic signal propagation through the connector 100 in the form of electromagnetic waves. As a coaxial transmission line, the connector 100 supports signal propagation as a transverse electromagnetic (TEM) wave.

Figure 6:
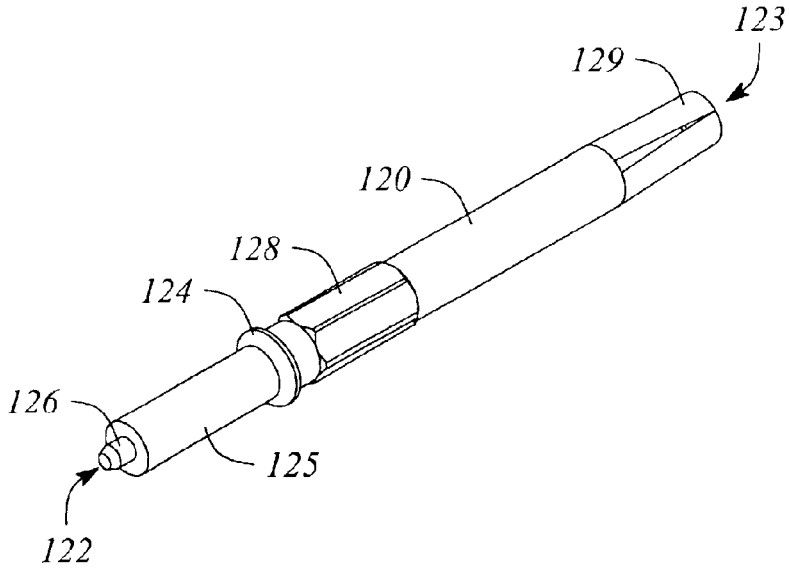
FIG. 6 illustrates a perspective view of an embodiment of a connector pin of the shielded SMT coaxial connector according to the present invention.

FIG. 6 illustrates a perspective view of an embodiment of the center pin 120 of the shielded SMT coaxial connector 100 according to the present invention. As illustrated in FIG. 6, the center pin 120 has a generally extended cylindrical shape a diameter of which is determined by a desired impedance of the coaxial transmission line according to well-known design equations for such transmission lines. As such, the diameter of the center pin 120 may vary along a length of the center pin 120 depending on a diameter of the inner surface of the shell 110 and a dielectric constant of a material present between the center pin 120 and the inner surface of the shell 110. The center pin 120 has a connection end 122 and a mating end 123, wherein the mating end 123 is distal or opposite to the connection end 122.

In some embodiments according to the present invention, the center pin 120 comprises a stop 124 and a stepped end portion 126. The stop 124 is a portion of the center pin 120 that has a larger diameter than a remainder of the center pin 120. A portion of the center pin 120 between the stop 124 and the mating end 123 is adapted to receive the pin support 130. In some embodiments, the stop 124 comprises a flange or shelf formed as a part of the center pin 120.

Advantageously, the stop 124 helps to prevent the center pin 120 from being pulled away from a surface of a PCB during mounting of the connector 100. For example, heating of the dielectric pin support 130 during soldering may cause the pin support 130 to expand. The stop 124 keeps the pin 120 from being pulled up and into the pin support 130 as a result of the heat related expansion, for example.

The stepped end portion 126 is a portion of the center pin 120 adjacent to the connection end 122 of the center pin 120. The stepped end portion 126 has a reduced width or diameter compared to a width or diameter of a pin portion 125 of the center pin 120 immediately adjacent to the stepped end 126, which is between the stepped end 126 and the stop 124. In some embodiments, the width or diameter of the stepped end portion 126 is reduced compared to a remainder of the connector pin 120. A ratio of the width or diameter of the stepped end 126 to the diameter of the pin 120 in the adjacent pin portion 125 beyond the stepped end 126 may be determined by an estimate of a thickness of a conductive attachment material such as, but not limited to, a solder, that is likely to accumulate at the stepped end portion 126 during connector 100 attachment. In other words, the determined ratio may accommodate the attachment material such that a resulting combined diameter of the attachment material and stepped end 126 is substantially similar to the diameter of the adjacent pin portion 125.

Advantageously, the stepped end portion 126 helps to control the overall diameter of a combination of the conductive attachment material and the center pin 120 in a vicinity of an attachment between the connector 100 and a PCB. In particular, the stepped end portion 126 advantageously enables the application of a sufficient amount of conductive attachment material to the center pin 120 to insure a secure and robust attachment of the center pin 120 to the PCB. Moreover, due to the stepped end portion 126, the overall diameter of the combination of attachment material and center pin 120 may be made to approximate the diameter of the center pin 120 at the adjacent portion 125. In essence, the stepped end portion 126 enables the diameter of the center pin 120 at the adjacent portion 125 to be carried or continued all the way to the connection end 122 without sacrificing a robustness of the conductive connection of the center pin 120 to the PCB.

For example, consider an application that employs a solder to attach the center pin 120 to a PCB and assume that a solder fillet having approximately 0.3-mm to 0. 0.4-mm thickness is desired and expected. Moreover, assume that the center pin 120 in the pin portion 125 between the stepped end portion 126 and the stop 124 has a diameter of 1.02-mm. In this example, the exemplary stepped end portion 126 may have a diameter of approximately 0.35-mm or about one third the diameter of the pin portion 125. The expected solder fillet thickness will result in an overall thickness of the solder and center pin 120 at the stepped end portion 126 that is approximately equal to the diameter of the adjacent pin portion 125. Thus, when the center pin 120 is soldered to the PCB, the combination of the solder fillet and the stepped end portion 126 will present a relatively small impedance discontinuity or mismatch while still insuring that the center pin 120 is adequately secured to the PCB.

The center pin 120 may further comprise a knurled, fluted or splined portion 128. The splined portion 128 is preferably located in a portion of the center pin 120 corresponding to a location of the pin support 130. The splined portion 128 assists in retaining or securing the center pin 120 within the pin support 130. In particular, the splined portion 128 helps to prevent the center pin 120 from rotating during repeated mating and unmating of the connector 100 with a complimentary connector at the mating end 123.

Preferably in addition to preventing rotation, the splined portion of 128 also allows material of the pin support 130 to expand along the center pin 120 in a direction that is essentially away from the connection end 122 of the center pin 120. Expansion in a direction away from the connection end 122 is hereinafter referred to as 'upward expansion' without limitation to the scope of the present invention. Expansion of the pin support 130 material may occur during heating cycles associated with attachment of the connector 100, for example. Such upward expansion of the pin support 130 material facilitated by the splined portion 128 reduces a chance that the expansion of the material will result in the connection end 122 being pulled away from the PCB during connector attachment.

In addition to employing the splined portion 128 to retain the center pin 120 within the pin support, any of various captivation means known in the art may be employed to retain the pin support 130 within the shell 110 of the connector 100. In particular, use of such captivation means may further reduce an incidence of center pin 120 rotation during connector 100 mating and unmating. Specifically, use of the captivation means may prevent the pin support 130 from rotating thereby preventing the secured center pin 120 from rotating. All such means of pin support 130 captivation are within the scope of the present invention.

For example, a pair of 'dimple-like' side crimps 117 may be used to secure the pin support 130 within the shell 110. Other captivation means including, but not limited to, epoxy captivation and the use of formed barbs on the inner surface of the shell may be used instead of or in addition to the exemplary side crimps 117. Moreover, if the side crimps 117 or other captivation means are located at or near a base end of the pin support 130 adjacent to the connection end 122 of the center pin 120, advantageous essentially upward expansion of the pin support 130 material may be further facilitated. Thus, a combined use of the splined portion 128 to secure the center pin 120 within the pin support 130 and the use of side crimps 117 or other captivation means at the base end of the pin support 130 to secure the pin support in the shell 110 advantageously further reduces the chance of the center pin 120 being pulled away from the PCB due to pin support 130 material expansion.

The center pin 120 may further comprise a mating portion 129 adjacent to the mating end 123 of the center pin 120. The mating portion 129 may have any one of a variety of mating configurations. The connector portion 112 of the shell 110 may be any one of a variety of connector classes. The connector class of the connector portion 112 dictates a specific configuration of the mating portion 129 of the center pin 120. For example, the mating portion 129 of a female, SMA connector class of the connector portion 112 may comprise a socket with four to six circumferentially array 'fingers'. The socket and fingers of the example are adapted to receive a mating pin of a male, SMA mating connector (not illustrated).

Referring again to FIG. 4, the pin support 130 comprises a rigid or semi-rigid insulating or dielectric material that extends from the center pin 120 to an inner surface of the shell 110 within a space created by the hole 118. The pin support 130 supports the center pin 120 at or near a center of the hole 118. In some embodiments, the pin support 130 may extend along a substantial portion of the length of the hole 118 within the connector portion 112 of the shell 110 of the coaxial connector 100 as illustrated in FIG. 4. In particular, the space within a substantial portion of the length of the hole 118 within the connector portion 112 may be essentially filled with a low-loss dielectric material such as, but not limited to, Teflon®. Teflon® is a trade name for polytetrafluoroethylene (PTFE), registered to E. I. Du Pont De Nemours and Company Corporation, 101 West 10th St., Wilmington, Del., 19898. The presence of the dielectric material in the space between the center pin 120 and the inner surface of the shell 110 serves to support the center pin 120 and thus acts or functions as the pin support 130.

For example, an embodiment of the coaxial connector 100 consistent with the aforementioned SMA connector class may have such an extended pin support 130 made of Teflon®. The pin support 130 for such an embodiment may be formed into a cylindrical 'bead' having an approximately central hole therethrough. Ideally, the central hole in the Teflon® bead is slightly smaller than a diameter of the center pin 120. To assemble the exemplary coaxial connector 100, the center pin 120 is inserted into the hole of the Teflon® bead. The assembly comprising the center pin 120 and the Teflon® bead pin support 130 thus crested is inserted into and secured within the hole 118 in the connector portion 112 of the shell 110. The pin support 130 is secured in the shell 110 using the exemplary side crimps 117 as illustrated in FIG. 4. One skilled in the art is familiar with Teflon® beads used as pin supports for SMA connectors and can readily apply such familiarity to the manufacture of the shielded SMT coaxial connector 100 according to the present invention.

In other embodiments (not illustrated), the pin support 130 may be confined to a small portion of the length of the hole 118 within the connector portion 112. Moreover, there may be more than one pin support 130. In particular, in such embodiments, a total length of the pin support(s) 130 along the center pin 120 may be minimized to a total length capable of adequately supporting the center pin 120 given a particular implementation of the pin support 130. Minimizing the length of the pin support 130 tends to reduce an effect that the support 130 has on a propagating electromagnetic wave passing through the connector 100. For example, an embodiment of the shielded SMT coaxial connector 100 of the present invention consistent with a 3.5-mm or 2.4-mm class of connectors may employ a pin support 130 having a minimized length to facilitate operation at frequencies up to and beyond 40 GHz.

As used herein, a coaxial transmission line in which the space between an inner and outer conductor (e.g., the space within the hole 118 surrounding the center pin 120) is substantially filled with a dielectric material, such as Teflon®, is referred to as a 'dielectric-filled' coaxial transmission line. Similarly, a coaxial transmission line in which the space between the inner and outer conductor is filled by a gas, for example air, is called an 'air dielectric' coaxial transmission line or more simply an 'air-line'. Thus in some embodiments, the coaxial transmission line within the connector portion 112 may be one or both of an air-line and a dielectric-filled coaxial transmission line. For example, the coaxial transmission line of the embodiment illustrated in FIG. 4 is a dielectric-filled coaxial transmission line throughout the connector portion 112. On the other hand, a portion of the coaxial transmission line within the base portion 114 and adjacent to the mounting end 115 of the coaxial connector 100 is an air-line. The air-line of the base portion 114 extends to and exits at the mounting end 115. Thus as illustrated in FIG. 3C and FIG. 4, the center pin 120 is surrounded by a gas and not surrounded by a solid dielectric material at or in a vicinity of the mounting end 115 of the coaxial connector 100 according to some embodiments.

Figure 5:
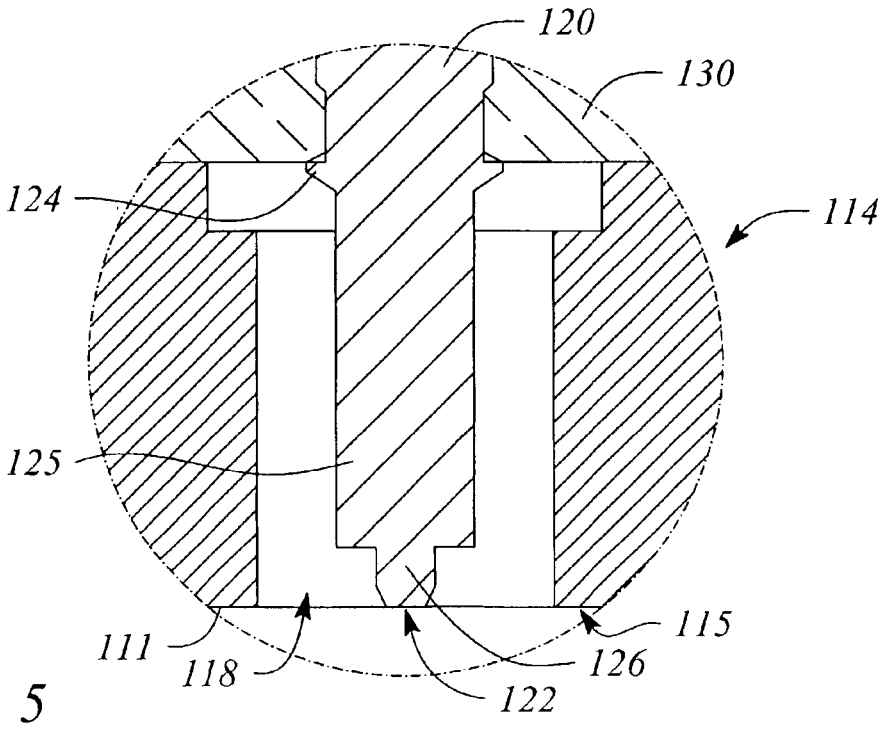
FIG. 5 illustrates a magnified cross-sectional view of a portion of the shielded SMT coaxial connector illustrated in FIG. 4 enclosed within a dashed circle labeled 5.

FIG. 5 illustrates a magnified cross-sectional view of a portion of the shielded SMT coaxial connector 100 illustrated in FIG. 4 that is enclosed within a dashed circle labeled 5 in FIG. 4. The magnified view of the portion illustrates the connection end 122 of the center pin 120 and the air-line coaxial transmission line within the base portion 114 of the coaxial connector 100. In particular, FIG. 5 illustrates the air-line of the base portion 114 extending from an end of the pin support 130 within the connector portion 112 to the mounting end 115. The air-line comprises the stepped end portion 126 and the immediately adjacent pin portion 125 of the center pin 120. Preferably, the annular flange 119 completely surrounds and shields the center pin 120 within the base portion 114. More preferably, the connection end 122 of the center pin 120 is essentially coplanar with a bottom surface 111 of the annular flange 119.

Advantageously, the use of an air-line within the base portion 114 minimizes a deleterious mechanical effect that an expansion of the dielectric of the pin support 130 might have on a conductive connection between the PCB and the center pin 120. Furthermore, a continuation of the coaxial transmission line as an air-line through the base portion 114 and to the mounting end 115 of the connector 100 provides shielding of the interface between the PCB and the connector 100. In particular, the presence of the coplanar annular flange 119 shields the center pin 120. The shielding provided by the present invention significantly reduces spurious EM radiation from and associated with the interface between the connector and the PCB compared to conventional SMT connectors known in the art. In addition, a relatively large and essentially continuous attachment surface afforded by the annular flange 119 of the coaxial connector 100 provides a highly secure and rugged means of attaching the coaxial connector 100 to the PCB.

Figure 7:
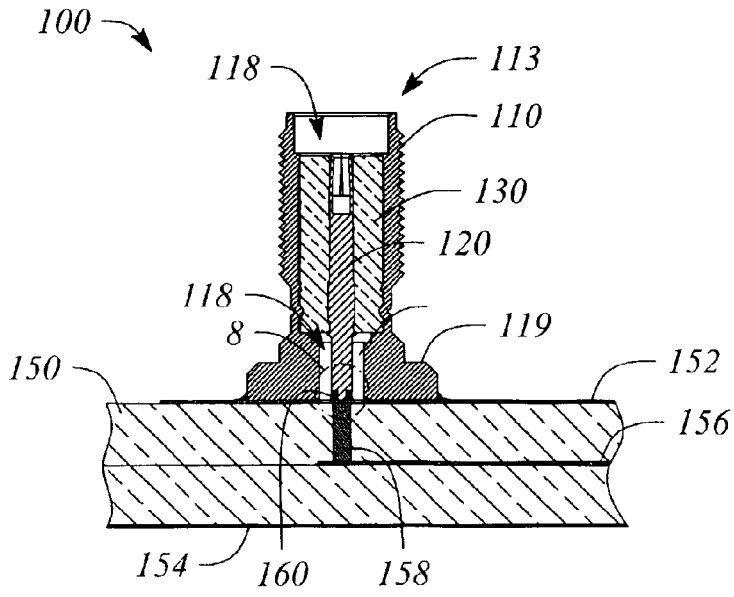
FIG. 7 illustrates a cross-sectional view of the shielded SMT coaxial connector illustrated in FIG. 4 attached to an exemplary printed circuit board (PCB).

FIG. 7 illustrates a cross-sectional view of an embodiment of the shielded SMT coaxial connector 100 illustrated in FIG. 4 attached to an exemplary PCB 150. The attachment is made using a solder or similar eutectic bonding material. As illustrated in FIG. 7, the exemplary PCB 150 is a multilayer PCB having a first surface, a second surface that is opposite to the first surface, and a buried stripline transmission line 156. The first surface has a first or 'top' ground plane 152, the second surface has a second or 'bottom' ground plane 154 and the buried stripline transmission line 156 is located between the ground planes 152, 154. The PCB 150 further has a blind via 158 that extends from the buried stripline to the first surface. The blind via 158 connects a solder pad 160 on the first surface to the stripline 156. The blind via 158 and the solder pad 160 are electrically isolated from the ground planes 152, 154. The coaxial connector 100 is attached to the top ground plane 152 by soldering, or otherwise electrically and mechanically affixing the annular flange 119 of the connector 100 to the top ground plane 152, for example. The center pin 120 may be soldered or otherwise electrically and mechanically affixed to the solder pad 160 to complete the attachment of the shielded SMT coaxial connector 100.

Figure 8:
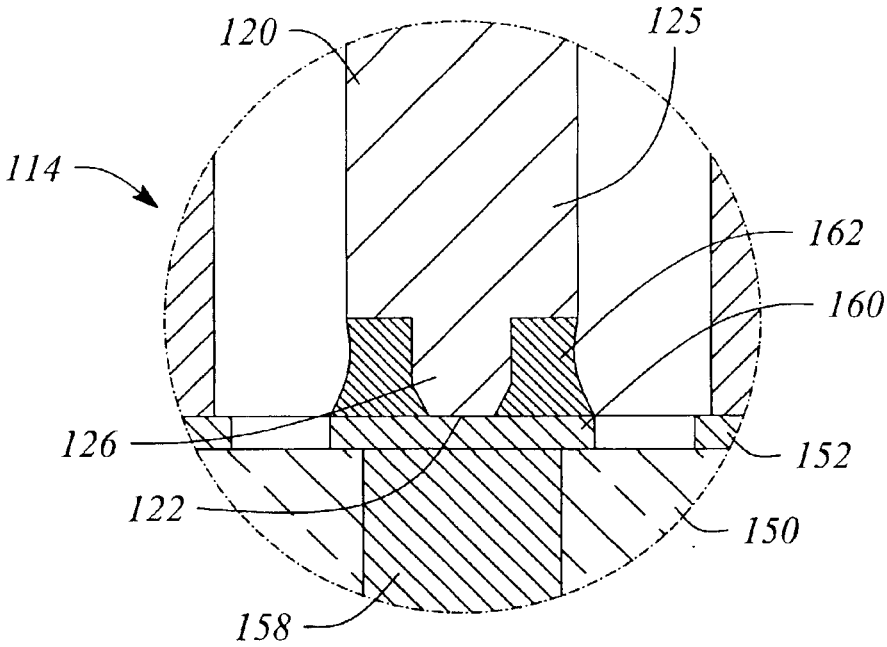
FIG. 8 illustrates a magnified cross-sectional view of a portion of the attached shielded SMT coaxial connector illustrated in FIG. 7 enclosed within a dashed circle labeled 8.

FIG. 8 illustrates a magnified cross-sectional view of a portion of the attached shielded SMT coaxial connector 100 illustrated in FIG. 7 enclosed within a dashed circle labeled 8. The portion illustrated in FIG. 8 depicts a solder connection between the connection end 122 of the center pin 120 and the solder pad 160 on the first surface of the PCB 150. In particular, a solder fillet 162 is illustrated bridging between the center pin 120 and the solder pad 160 at the stepped end portion 126 of the pin 120. Note that a diameter of the combination of the center pin 120 in the stepped end portion 126 and the solder fillet 162 is approximately equal to the diameter of the center pin 120 in the adjacent pin portion 125. In particular, when solder flows into the stepped end portion 126 during soldering, the resulting combined diameter of the solder fillet 162 and center pin 120 at the stepped end portion 126 advantageously closely approximates the diameter of the center pin 120 in the immediately adjacent pin portion 125. Such a novel accommodation of the solder fillet 162 within the diameter of the adjacent pin portion 125 achieves a substantially constant air-line diameter and greatly reduces a potential for introducing an impedance mismatch discontinuity associated with solder attachment of the center pin 120 of the shielded SMT coaxial connector 100.

Figure 9:
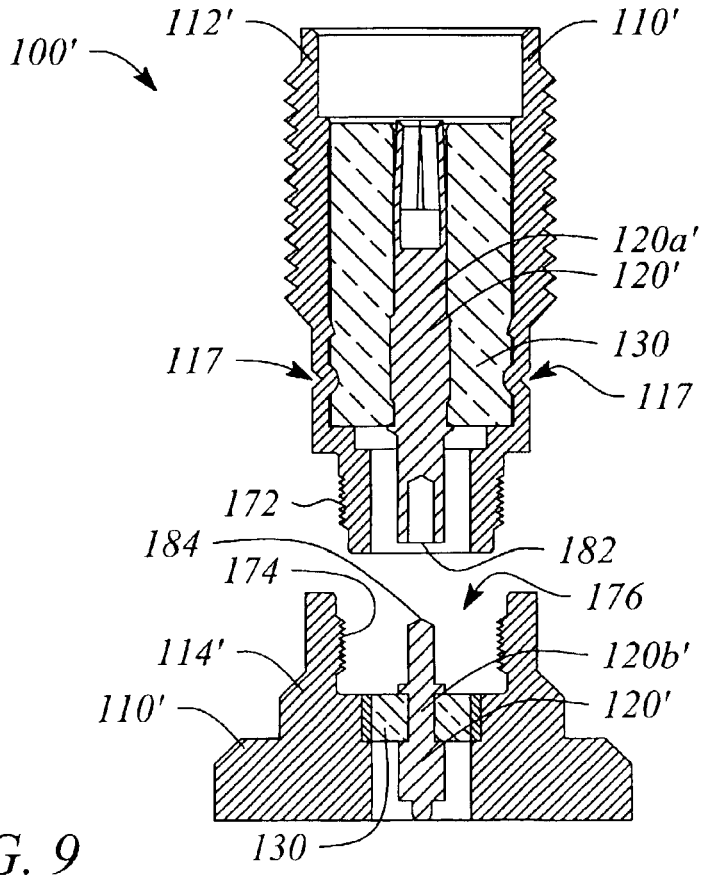
FIG. 9 illustrates a cross-sectional view of an embodiment of a two-piece shielded SMT coaxial connector according to the present invention.

FIG. 9 illustrates a cross-sectional view of an embodiment of a two-piece shielded SMT coaxial connector 100' according to the present invention. The two-piece connector 100' comprises a shell 110', the shell 110' comprising a connector assembly 112' and a base assembly 114', wherein the connector assembly 112' and base assembly 114' are separable from one another. The constituent elements of the connector assembly 112' and base assembly 114' are essentially those described for the connector portion 112 and base portion 114, respectively, of the shielded SMT coaxial connector 100 hereinabove. While having essentially the same constituent elements, there are several notable exceptions necessitated by the 'separable nature' of the two-piece connector embodiment 100'.

A primary exception is that the center pin 120' of the two-piece connector 100' is a two-piece center pin 120' comprising a connector assembly pin 120*a*' and a base assembly pin 120*b*'. The connector assembly pin 120*a*' and base assembly pin 120*b*' provide means for cooperatively engaging one another. For example, the connector assembly pin 120*a*' may comprise a socket 182 while the base assembly pin 120*b*' may comprise a plug 184, the socket 182 and plug 184 being adapted to cooperatively engage. Those skilled in the art are familiar with other means for cooperatively engaging pins together, all of which are also within the scope of the present invention.

In addition, the connector assembly 112' and base assembly 114' of the two-piece connector 100' provide means for cooperatively engaging or connecting to one another. For example, FIG. 9 illustrates an embodiment of the connector assembly 112' having a set of screw threads 172 on an outer surface of the connector assembly 112'. Similarly, the base portion 114' of the embodiment illustrated in FIG. 9 has a set of screw threads 174 on an inner surface of a cavity 176 in the base assembly 114'. The screw threads 172 are complementary to the screw threads 174. Thus, when the connector assembly 112' is received by the cavity 176 of the base assembly 114', the two sets of screw threads 172, 174 cooperatively engage, thereby providing a mechanical and electrical connection between the assemblies 112', 114' of the two-piece shell 110'. Those skilled in the art are familiar with other means for cooperatively engaging the shell assemblies together, all of which are also within the scope of the present invention. Likewise, the connector assembly pin 120*a*' and a base assembly pin 120*b*' are cooperatively engaged when the assemblies 112', 114' are connected together.

Figure 10:
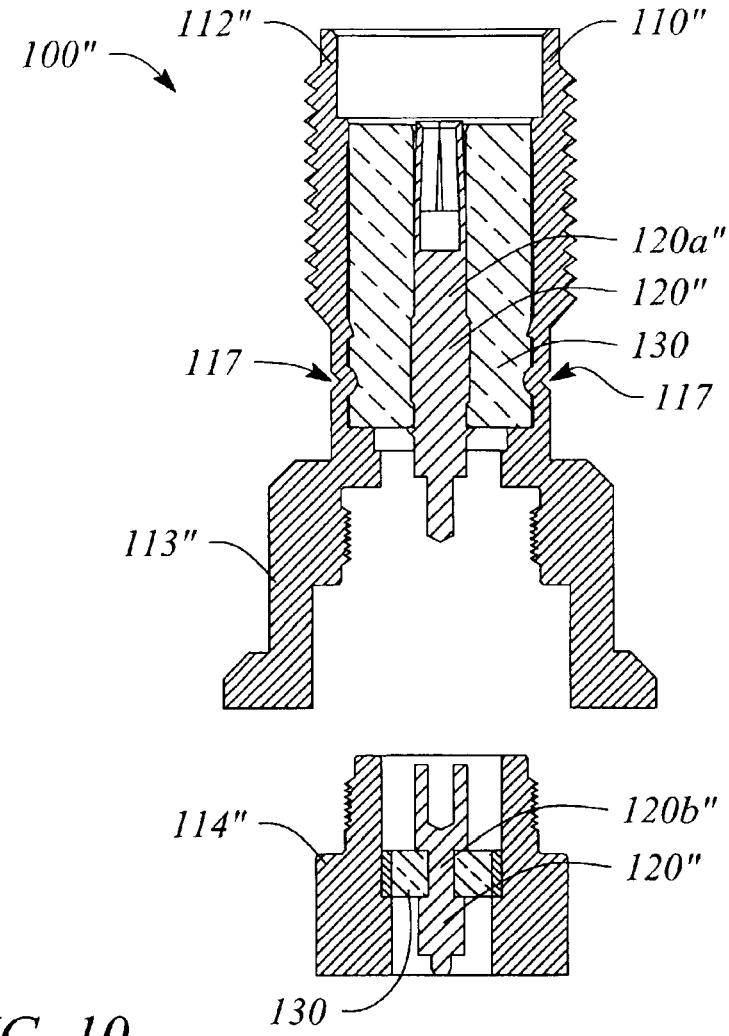
FIG. 10 illustrates a cross-sectional view of another embodiment of the two-piece shielded SMT coaxial connector according to the present invention.

FIG. 10 illustrates a cross-sectional view of another embodiment of the two-piece shielded SMT coaxial connector 100" according to the present invention. The embodiment illustrated in FIG. 10 differs from the shielded SMT connector 100' illustrated in FIG. 9 in a few aspects. The shielded SMT connector 100" comprises a shell 110" having a base assembly 114" and a connector assembly 112". The connector assembly 112" is similar to the connector assembly 112' described above except that the connector assembly 112" further comprises a shield portion 113". The shield portion 113" fits around the base assembly 114" of the shell 110" when the connector assembly 112" and base assembly 114" are cooperatively engaged together. In the two-piece shielded SMT coaxial connector 100' described above, the base assembly 114' comprises a circumferential flange, similar to the flange 119 described above for the shielded SMT coaxial connector 100. However in the two-piece embodiment 100" illustrated in FIG. 10, the shield portion 113" comprises the circumferential flange and the base assembly 114" does not and need not include such a circumferential flange. The shield portion 113" provides EM shielding for the shielded SMT coaxial connector 100" in the base portion. Unlike other embodiments disclosed hereinabove, the base assembly 114" advantageously need not completely surround a base assembly pin 120*b*" since shielding is provided by the shield portion 113" of the connector assembly 112".

Also illustrated in FIG. 10 is that the means for cooperatively engaging the connector pin portions 120*a*" and 120*b*" of the connector pin 120" employs a complementary socket and plug embodiment, similar to the socket 182 and plug 184 of the two-piece connector embodiment 100' illustrated in FIG. 9. However, FIG. 10 illustrates the socket and plug embodiment in reversed pin portions compared to that illustrated in FIG. 9. This illustration is for exemplarily purposes only and not by way of limitation.

Both of the two-piece embodiments of the shielded SMA coaxial connector 100', 100" comprise the connector pin 120', 120" with a stepped end portion, an immediately adjacent pin portion and a stop that are similar or equivalent to the stepped end portion 126, the immediately adjacent pin portion 125 and the stop 124 of the connector pin 120 for the one-piece shielded SMA coaxial connector 100, as described above. Therefore, the two-piece connector embodiments 100', 100" have all of the features and advantages of achieving an essentially constant air-line diameter in the base assembly 114', 114" that are described above for the stepped end portion 126 and the solder fillet 162 when the respective connector 100', 100" is attached to a PCB.

The shell 110, 110', 110" is preferably fabricated from an electrically conductive material. More preferably, the conductive material, such as a metal that is readily machined, is employed to facilitate fabrication of the various portions of the shell 110, 110', 110". For example, a metal such as, but not limited to, Stainless Steel, Iron-Nickel, Copper, Tungsten or Brass, or any other metal conventionally used in fabricating high frequency coaxial connectors may be used. Alternatively, the shell 110, 110', 110" may be fabricated from an electrically non-conductive material. When a non-conductive material is employed, an electrically conductive coating is deposited on a surface of the shell 110, 110', 110" during fabrication to render the shell 110, 110', 110" electrically conductive.

For high frequency applications of the one-piece connector 100 and/or the two-piece connectors 100', 100", especially above about 1 GHz, an outer surface of the shell 110, 110', 110", as well as an inner surface of the shell 110, 110', 110" created by the hole 118, are preferably plated with a material, such as gold (Au), to improve conductivity and control or minimize corrosion. In some embodiments, additional plating layers are applied before the gold (Au) layer is applied to facilitate adhesion or improve plating reliability. For example, the shell 110, 110', 110" may be plated with an undercoat of nickel (Ni) prior to being plated with gold (Au).

The use of plating for improving conductivity (i.e., decreasing ohmic loss) and/or for controlling corrosion in high frequency coaxial connectors is well known to one skilled in the art. A choice of the conductive material for the shell 110, 110', 110" and/or the use of a particular type of plating are not intended to limit the scope of the present invention. One skilled in the art is familiar with a wide range of materials used for fabricating and/or plating high frequency connectors that are suitable for use in fabricating the shell 110, 110', 110" of the present connectors 100, 100', 100". All such materials and platings are within the scope of the present invention.

The center pin 120, 120', 120" is an electrical conductor, preferably a metal. The center pin 120, 120' may be fabricated from an electrically conductive material or a non-conductive material by machining, stamping or forming. The non-conductive material is further plated with an electrically conductive plating. For example, the center pin 120, 120', 120" may be fabricated by machining a metal such as, but not limited to, beryllium-copper, brass, KOVAR™, tungsten or molybdenum preferably plated with gold (Au). KOVAR™, a registered trademark for a nickel-cobalt-iron alloy, is registered to Westinghouse Electric & Manufacturing Company, Pittsburgh, Pa. In particular, Tungsten and Molybdenum generally possess a high strength enabling them to survive fabrication and repeated mating and un-mating during operational use of the connector 100, 100', 100". Preferably, the center pin 120, 120', 120" is gold (Au) plated along the entire length of the pin 120, 120', 120". While several suitable metal materials are listed for the connector pin 120, 120', 120" hereinabove by way of example, the listed exemplary materials are not intended to limit the scope of the present invention in any way. Those skilled in the art are aware of other materials that are useful for the connector pin 120, 120', 120", all of such other materials are also within the scope of the present invention.

As mentioned hereinabove, a main criterion for choosing the dielectric material for the pin support 130 of the shielded SMT coaxial connector 100, 100', 100" is whether or not the material can adequately support the center pin 120, 120', 120" while simultaneously producing a minimal loss in, or disruption of, the TEM wave propagating through the connector 100, 100', 100". Dielectric materials including, but not limited to, borosilicate glass, alumina ceramic and various glass-ceramic materials, such as Macor™, may be used for the pin support 130 as an alternative to a dielectric material such a Teflon® mentioned previously herein. Macor™ is a trademark for unworked or semi-worked glass-ceramic materials, registered to Corning Glass Works, Houghton Park, N.Y., 14830.

Figure 11:
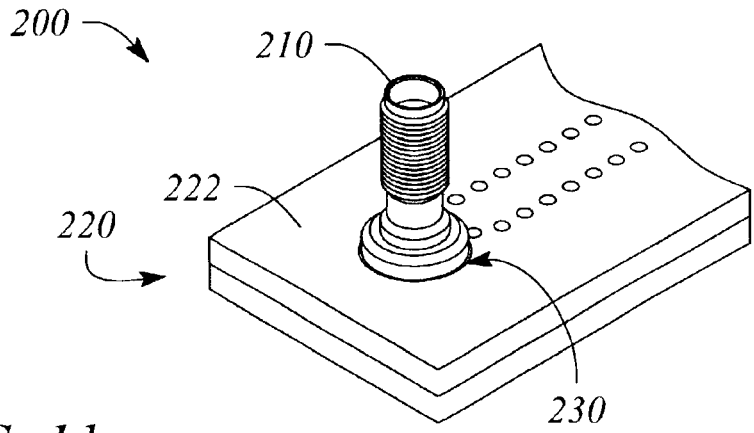
FIG. 11 illustrates a perspective view of an embodiment of a system for removably connecting to an RF or microwave device using a shielded SMT coaxial connector according to the present invention.
Figure 12:
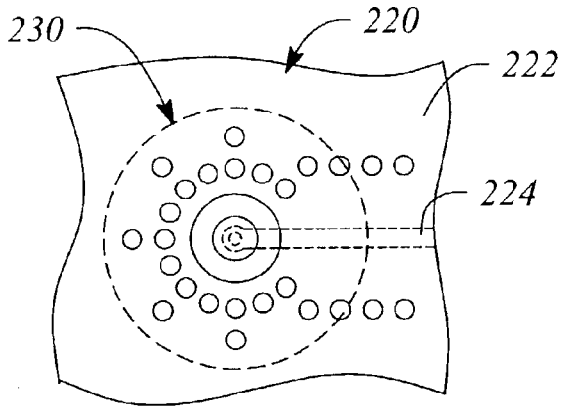
FIG. 12 illustrates a surface view of an embodiment of a PCB mounting footprint adapted to a shielded, SMT coaxial connector according to the present invention.
Figure 13:
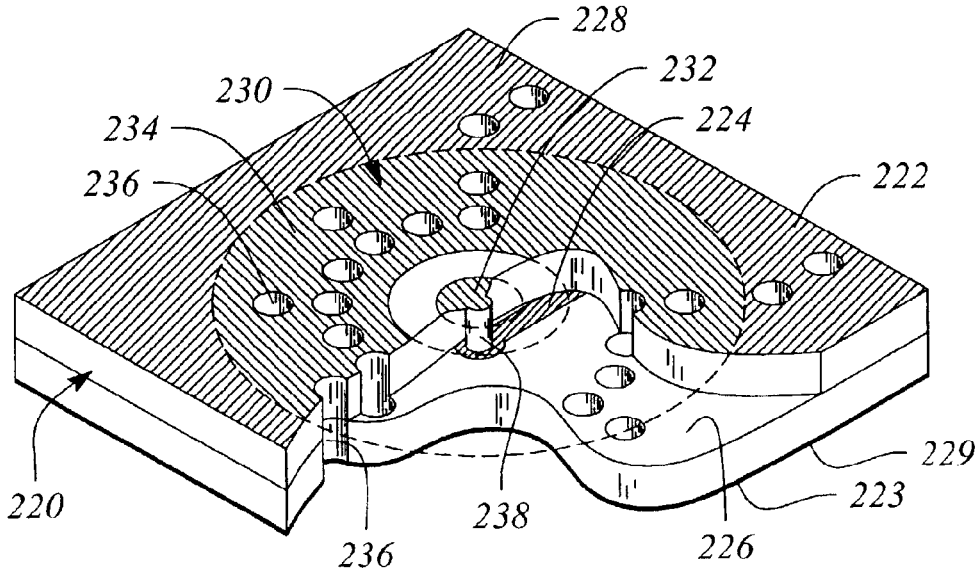
FIG. 13 illustrates a cut-away, perspective view of the PCB mounting footprint illustrated in FIG. 12.

In another aspect of the invention, a system 200 for removably connecting to an RF or microwave device fabricated in or on a multilayer printed circuit board using a shielded SMT coaxial connector is provided. FIG. 11 illustrates a perspective view of an embodiment of the system 200 for removably connecting to an RF or microwave device according to the present invention. FIG. 12 illustrates a surface view of an embodiment of a PCB mounting footprint 230 adapted to the shielded, SMT coaxial connector according to the present invention. FIG. 13 illustrates a cutaway, perspective view of the PCB mounting footprint 230 illustrated in FIG. 12.

The system 200 comprises a shield SMT coaxial connector 210, a multilayer printed circuit board (PCB) 220 and a mounting footprint 230 on a first or 'top' surface or layer 222 of the PCB 220. The shield SMT connector 210 may be any of the shielded SMT coaxial connector 100, 100', 100" embodiments described hereinabove. The multilayer PCB 220 comprises a planar transmission line 224 connected to the mounting footprint 230. The planar transmission line 224 is located on a layer 226 below the top layer 222. The mounting footprint 230 is adapted to accept the shielded SMT coaxial connector 210 and provides means for mounting the shield SMT coaxial connector 210 to the PCB 220 and means for electrically interfacing the connector 210 to the transmission line 224 of the PCB 220.

The mounting footprint 230 of the system 200 comprises an annular ring-shaped pad 234. The annular pad has a plurality of vias 236 arranged through the annular pad 234 and an approximately centrally located void that electrically isolates the annular pad 234. The mounting footprint 230 further comprises a center pad 232 that is located in the central void. The center pad 232 and the annular pad 234 are provided as an electrically conductive material on the top surface 222 of the PCB 220. For example, the center pad 232 and the annular pad 234 may be etched copper foil bonded to the top surface 222, wherein the etching is used to define a shape of the pads 232, 234. A blind via 238 or another equivalent means for electrical connection connects the center pad 232 to the transmission line 224. The center pad 232 is electrically isolated from the annular pad 234. The annular pad 234 is preferably electrically connected to and more preferably, continuous with a first ground plane 228 on the top surface 222 of the PCB 220.

Each of the vias of the plurality 236 is a hole passing from the top surface 222 to a second or 'bottom' surface 223 of the PCB 220. As the name might imply, the bottom surface 223 is opposite to the top surface 222. Preferably, the vias 236 are plated with a conductive material on an inside surface and otherwise provide an opening between the top surface 222 and the bottom surface 223. The plurality of vias 236 is arranged in an annular pattern within the annular pad 234.

In some embodiments, a second ground plane 229 is located on the bottom surface 223. In such embodiments, the vias 236 may be electrically connected to the second ground plane 229. In other embodiments, one or more additional ground planes (not illustrated) are provided between the first ground plane 228 and the second ground plane 229. In these embodiments, the vias 236 may be electrically connected to one or more of the additional ground planes in addition to or instead of being connected to the second ground plane 229.

Moreover, an additional ring of vias (not illustrated) may be employed concentrically between the vias 236 and a boundary of the central void. The additional ring of vias may be used to help compensate or 'match' an impedance of the blind via 238 to an impedance of one or both of the transmission line 224 and the shield SMT coaxial connector 210. When the additional ring of vias are used, the vias 236 essentially serve to provide shielding for the system 200 while the additional ring of vias provides impedance matching. Furthermore, other matching structures (not illustrated) such as holes in the first ground plane 228, holes in the second ground plane 229, holes in the additional ground planes, and various stubs and coupled sections on the transmission line 224 may be employed to help with impedance matching. One of skilled in the art is familiar with a wide variety of impedance matching techniques that may be used all of which are within the scope of the present invention.

The system 200 is assembled by applying a conductive attachment material such as, but not limited to, a solder material to the center pad 232 and to the annular pad 234. Alternatively or in addition, the conductive attachment material may be applied to a connector pin and an annular flange-mounting surface of the coaxial connector 210. The coaxial connector 210 is then placed in contact with the PCB 220 and aligned with the footprint 230. The aligned connector 210 has the flange-mounting surface aligned with the annular pad 234 and the connector pin aligned with the center pad 232. In the case of solder, the solder may be reflowed to attach the connector 210 to the PCB 220. Advantageously, the plurality of vias 236 allow excess attachment material to move out from between the flange and the annular pad 234 facilitating attachment while reducing a possibility of a short circuit being created between the center pad 232 and the annular pad 234. For example, when solder is used as the conductive attachment material, excess solder tends to flow into the open vias 236 during solder reflow.

The presence of the plurality of vias 236 through their collective action with respect to excess solder also advantageously and unexpectedly assists in aligning the coaxial connector 210 during reflow and in adding mechanical strength to a bond between the connector 210 and the PCB 220. In particular, surface tension of a solder fillet formed along the boundary of the annular pad 234 at the central void preferentially aligns the connector 210 to the annular pad 234 during solder reflow. Moreover, removal of excess solder from between the coaxial connector 210 and the annular pad 234 by the plurality of vias 236 tends to leave a relatively thin solder bondline. Thin solder bondlines are known to be generally stronger than thick bondlines or layers of solder. Furthermore, presence of solder within the vias 236 increases the strength of the bond between the annular pad 234 and the coaxial connector 210 attached thereto. Essentially, the solder within the vias 236 enables the vias 236 to act as rivets through the PCB 220. The annular pad 234 and coaxial connector 210 are effectively 'riveted' to the PCB 220 thereby increasing the overall strength of the system 200.

Accordingly, the system 200 advantageously achieves a substantially constant air-line diameter in the connector 210 at or adjacent to the connector/PCB interface using the conductive attachment material and all of the advantages described above for such a constant air-line diameter. In addition, the plurality of vias 236 provides a coaxial ground structure within the PCB 220 and that helps to shield the system 200 and minimize a transitional impedance discontinuity between the coaxial connector 210 and the transmission line 224.

Figure 14:
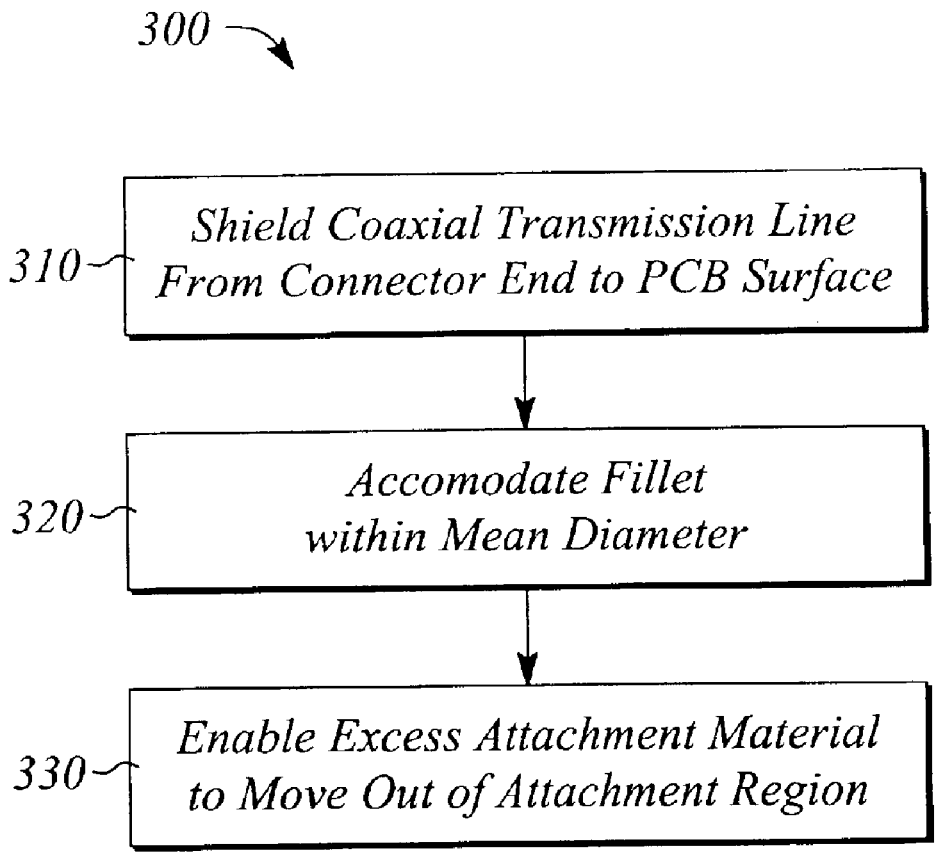
FIG. 14 illustrates a flow chart of a method of interfacing according to an embodiment of the present invention.

In another aspect of the invention, a method 300 of interfacing to a printed circuit board (PCB) is provided. FIG. 14 illustrates a flow chart of the method 300 of interfacing according to an embodiment of the present invention. The method 300 of interfacing comprises shielding 310 a portion of a coaxial transmission line in a surface-mountable coaxial connector. The portion of the coaxial transmission line that is shielded 310 is a connector portion adjacent to a mounting surface of the PCB, when the connector is attached to the PCB. In particular, shielding is essentially continuous from the connector portion of the connector to a mounting surface of the connector, such that no gaps are present between the connector mounting surface and the mounting surface of the PCB once the connector is attached to the PCB. The connector is attached to the PCB with a conductive attachment material. The method 300 further comprises accommodating a fillet of the conductive attachment material. The center pin of the connector includes a pin end portion with a reduced diameter at a pin end thereof, and an immediately adjacent pin portion, both within the shielded connector portion of the connector. The pin end of the pin end portion is adjacent to the mounting end of the connector. The diameter of the pin end portion is reduced relative to the immediately adjacent pin portion. The adjacent pin portion is opposite to the pin end that is adjacent to mounting end of the connector. In particular, when the attachment material is applied to the connector pin of the connector during connector attachment, the attachment material is accommodated such that a mean diameter of the fillet plus the center pin along a length of the fillet is approximately equal to the diameter of the adjacent pin portion of the connector pin. The method optionally further comprises enabling excess attachment material to move out of a space between an attachment flange of the connector and an attachment footprint on the PCB during connector attachment.

Thus, there has been described a shielded SMT coaxial connector, a system using a shielded SMT coaxial connector, and a method of interfacing a shielded surface-mountable coaxial connector to a printed circuit board. It should be understood that the above-described embodiments are merely illustrative of some of the many specific embodiments that represent the principles of the present invention. Those skilled in the art can readily devise numerous other arrangements without departing from the scope of the present invention.

What is claimed is:

1. A system for removably connecting to a radio frequency RF or microwave device, the system comprising:

a surface mountable coaxial conector comprising an electromagnetic shield that shields by surrounding and enclosing an interface created between the coaxial connector and a planar circuit when the connector is attached to the planar circuit;

a planar circuit, the planar circuit being a multilayer circuit having a planar transmission line buried between other layers of the planar circuit, and one or more ground planes disposed on one or more of the other layers; and a mounting footprint on an exposed surface of the planar circuit, the mounting footprint being adapted to accept the coaxial connector, the planar circuit further has a blind via connecting the buried transmission line to the mounting footprint, wherein the mounting footprint comprises a footprint comprises a footprint portion for mounting the coaxial connector to the exposed surface of the planar circuit and a portion for electrically connecting a coaxial transmission line of the coaxial connector to the buried transmission line.

2. The system for removably connecting of claim 1, wherein the footprint portion comprises an annular ring shaped pad of an electrically conductive material on the exposed surface of the planar circuit, the annular pad electrically connecting to a ground plane on the exposed surface, the annular pad having a central void that isolates the annular ring shaped pad in the central void.

3. The system for removably connecting of claim 2, wherein the portion for electrically connecting comprises a pad of an electrically conductive material on the exposed surface of the planar circuit within the central void, the pad being aligned with the blind via and being electrically connected to the buried planar transmission line, the pad being electrically isolated from and surrounded by the annular pad.

4. A surface mountable coaxial connector comprising:

an electromagnetic shield that shields by surrounding and enclosing an interface creatd between the coaxial connector and a planar circuit when the connector is attached to the planar circuit; and a coaxial transmission line comprising a connector pin coaxially disposed in a through hole along a longitudinal axis of a tubular connector shell, the connector shell having a connector portion and an adjacent base portion, the connector pin extending through the connector portion and the base portion, wherein the connector pin is supported by a pin support in the connector portion, the coaxial transmission line being an air dielectric coaxial transmission line or air-line in the base portion.

5. The coaxial connector of claim 4, wherein the coaxial transmission line further comprises a mechanical stop that extends perpendicular from a perimeter of the connector pin adjacent to the pin support, the mechanical stop facilitating maintaining the connector pin stationary in the connector during connector attachment.

6. The coaxial connector of claim 4, wherein the connector shell is of unitary construction, such that the connector portion and the base portion are integral portions of a one piece connector.

7. The coaxial connector of claim 4, wherein the connector portion and the base portion are separable assemblies of a two-piece connector shell, the connector portion assembly and the base portion assembly having complementary interfaces that removably connect the separable assemblies together.

8. The coaxial connector of claim 4, wherein the electromagnetic shield comprises a mounting end of the base portion, the mounting end being annular in shape and coplanar with a connection end of the connector pin, the coplanar mounting end being adjacent to the interface to provide electromagnetic shielding to the connection end of the connector pin at the interface.

9. The coaxial connector of claim 4, further comprising:

an impedance mismatch reducer that reduces an impedance mismatch between the coaxial transmission line and a transmission line of the planar circuit at the interface.

10. The coaxial connector of claim 9, wherein the impedance mismatch reducer comprises:

a reduced diameter portion of the connector pin that terminates at the connection end of the connector pin, the reduced diameter portion having a diameter that is smaller than a diameter of an immediately adjacent pin portion of the connector pin, the immediately adjacent pin portion being opposite to the connection end of the connector pin, the air-line comprising the reduced diameter portion, the connection end and the immediately adjacent pin portion of the connector pin.

11. The coaxial connector of claim 10, wherein the impedance mismatch reducer accommodates the further comprises:

an amount of a conductive attachment material used to attach the connector pin to the planar circuit at the connection end, the amount of attachment material being comparable to an amount that the diameter of the reduced diameter portion is reduced, the attachment material wicking along the reduced diameter portion during connector attachment, such that an overall diameter of the reduced diameter portion plus the wicked attachment material is relatively equivalent to the diameter of the adjacent pin portion, the overall diameter being relatively equivalent as compared to the diameter of the reduced diameter portion before connector attachment.

12. The coaxial connector of claim 10, wherein a diameter of the air-line remains relatively constant after connector attachment to maintain an impedance match between the air-line of the connector and the transmission line of the planar circuit, the diameter of the air-line being constant relative to a change in diameters of the reduced diameter portion and the adjacent pin portion before connector attachment.

13. A method of interfacing a surface mountable coaxial connector to a printed circuit board comprising:

electromagnetically shielding a portion of a coaxial transmission line of coaxial connector, the portion that is shielded is an air dielectric portion of the coaxial transmission line or air-line that is adjacent to an interface created between the coaxial connector and the printed circuit board when the coaxial connector is attached; and accommodating a fillet of a conductive attachment material that is used to attach the air-line to the printed circuit board, such that a constant diameter of the air-line adjacent to the interface is achieved.

14. The method of claim 13, further comprising:

enabling excess attachment material to exit an attachment region of the interace between the coaxial connector and the printed circuit board.

15. The method of claim 13, wherein shielding comprises attaching a mounting end of the coaxial connector to the printed circuit board, the mounting end being coplanar with the air-line at the interface, the mounting end providing an annular shield around the air-line at the interface.

16. The method of claim 13, wherein accommodating the fillet comprises reducing a diameter of a portion of the air-line at the interface by an amount comparable to an amount of the attachment material used to attach the air-line to the printed circuit board, the attachment material wicking along the reduced diameter portion to form the fillet, a combined diameter of the fillet and the reduced diameter portion being equivalent to a diameter of a portion of the air-line adjacent to the reduced diameter portion, such that the overall diameter of the air-line remains constant.

17. A surface mountable coaxial connector comprising:

an impedance mismatch reducer that reduces an impedance mismatch at an interface created between a coaxial transmission line of the connector and a planar transmission line of a planar circuit when the connector is attached to the planar circuit, the coaxial tranmission line being an air dielectric coaxial transmission line or air-line at the interface, the impedance mismatch reducer comprising an accommodation for a fillet of conductive attachment material used to attach the air-line to the planar circuit yielding a constant diameter of the air-line after connector attachment to the planar circuit.

18. The coaxial connector of claim 17, further comprising the coaxial transmission line, the coaxial tranmission line comprising a connector pin coaxially supported in a through hole along a longitudinal axis of a tubular connector shell, the connector shell having a connector portion and a base portion, the connector pin extending through the connector portion and the base portion, the base portion being adjacent to the interface during connector attachment, the air-line being in the base portion.

19. The coaxial connector of claim 18, wherein the connector shell is of unitary construction, such that the connector portion and the base portion are integral portions of a one-piece connector.

20. The coaxial connector of claim 18, wherein the connector portion and the base portion are separable assemblies of a two-piece connector shell, the connector portion assembly and the base portion assembly having complementary interfaces that removably connect the separable assemblies together.

21. The coaxial connector of claim 18, wherein the impedance mismatch reducer further comprises a portion of the connector pin in the air-line having a diameter that is reduced, the reduced diameter portion having a connection end of the air-line that is adjacent to the interface, the diameter of the reduced diameter portion being reduced relative to a diameter of an adjacent portion of the connector pin in the air-line, the adjacent pin portion being opposite to the connection end.

22. The coaxial connector of claim 21, wherein the impedance mismatch reducer further comprises:

an amount of a conductive attachment material used to attach the connector pin to the transmission line of the planar circuit at the connection end, the amount of attachment material being comparable to an amount that the diameter of the reduced diameter portion is reduced, the attachment material wicking along the reduced diameter portion during connector attachment, such that an overall diameter of the reduced diameter portion plus the wicked attachment material is relatively equivalent to the diameter of the adjacent pin portion, the overall diameter being relatively equivalent as compared to the diameter of the reduced diameter portion before connector attachment.

23. The coaxial connector of claim 18, wherein the coaxial transmission line further comprises a mechanical stop on a perimeter of the connector pin, the mechanical shop facilitating maintaining the connector pin stationary during connector attachment.

24. The coaxial connector of claim 17, further comprising:

an electromagnetic shield that shields by surrounding and enclosing interface.

25. The coaxial connector of claim 24, wherein the electromagnetic shield comprises:

a mounting end of the connector that is adjacent to the interface, the mounting end being coplanar with a connection end of the air-line, the coplanar mounting end providing electromagnetic shielding to the air-line at the interface.

26. The coaxial connector of claim 25, wherein the coplanar mounting end comprises an annular mounting surface that attaches to the planar circuit during connector attachment, the connection end of the air-line further attaching to the transmission line of the planar circuit during connector attachment.

27. A system for removably connecting to a radio frequency RF or microwave device using the surface mountable coaxial connector of claim 17, the system comprising:

the planar circuit, the planar circuit being a multilayer circuit having the planar transmission line buried between other layers of the planar circuit, and one or more ground planes disposed on one or more of the other layers; and a mounting footprint on an exposed surface of the planar circuit the mounting footprint being adapted to accept the coaxial connector, the planar circuit further has a blind via connecting the buried transmssion line to the mounting footprint, wherein the mounting footprint comprises a footprint portion for mounting the coaxial connector to the exposed surface of the planar circuit and a portion for electrically connecting the air-line of the coaxial connector to the buried transmission line.

28. The system for removably connecting of claim 27, wherein the footprint portion comprises an annular ring shaped pad of an electrically conductive material on the exposed surface of the planar circuit, the annular pad electrically connecting to a ground plane on the exposed surface, the annular pad having a central void that isolates the annular ring shaped pad in the central void.

29. The system for removably connecting of claim 28, wherein the portion for electrically connecting comprises a pad of an electrically conductive material on the exposed surface of the planar circuit within the central void, the pad being aligned with the blind via and being electrically connected to the buried planar transmission line, the pad being electrically isolated from and surrounded by the annular pad.

30. A system for removably connecting to a radio frequency RF or microwave device comprising:

a multilayer planar circuit having a planar transmission line buried between layers of the planar circuit, and one or more ground planes disposed on one or more of the layers;

a surface mountable coaxial connector comprising an electromagnetic shield that shields an interface created between the coaxial connector and the planar circuit when the connector is attached to the planar circuit; and a mounting footprint on an exposed surface of the planar circuit, the planar circuit further has a blind via connecting the buried transmission line to the mounting footprint, the mounting footprint being adapted to accept the coaxial connector, wherein the mounting footprint comprises a footprint portion for mounting the coaxial connector to the exposed surface of the planar circuit and a portion for electrically connecting a coaxial transmission line of the coaxial connector to the buried transmission line.

31. The system for removably connecting of claim 30, wherein the footprint portion comprises an annular ring shaped pad of an electrically conductive material on the exposed surface of the planar circuit, the, annular pad electrically connecting to a ground plane on the exposed surface, the annular pad having a central void that isolates the annular ring shaped pad in the central void.

32. The system for removably connecting of claim 31, wherein the portion for electrically connecting comprises a pad of an electrically conductive material on the exposed surface of the planar circuit within the central void, the pad being aligned with the blind via and being electrically connected to the buried planar transmission line, the pad being electrically isolated from and surrounded by the annular pad.

33. The system for removably connecting of claim 31, wherein the annular pad further has a plurality of vias arranged in annular pattern, the plurality of vias extending through the multilayer planar circuit to a surface opposite the exposed surface.

34. The system for removably connecting of claim 33, wherein the plurality of vias providing a path for excess attachment material to exit, the attachment material being used to attach the coaxial connector to the annular pad.

35. The system of claim 30, wherein the coaxial connector further comprises an impedance mismatch reducer that reduces an impedance mismatch between the coaxial transmission line and the buried transmission line of the planar circuit at the interface, the coaxial transmission line being an air dielectric transmission line or air-line adjacent to the interface with the planar circuit, wherein the impedance mismatch reducer comprises:

a reduced diameter portion of the air-line that terminates at a connection end of the air-line, the reduced diameter portion having a diameter that is smaller than a diameter of an immediately adjacent portion of the air-line, the immediately adjacent portion being opposite to the connection end; and an amount of a conductive attachment material used to attach the air-line to the center pad of the mounting footprint, the amount of attachment material being comparable to an amount that the diameter of the reduced diameter portion of the air-line is reduced, the attachment material wicking along the reduced diameter portion during connector attachment, such that an overall diameter of the reduced diameter portion plus the wicked attachment material is relatively equivalent to the diameter of the adjacent portion, the overall diameter being relatively equivalent as compared to the diameter of the reduced diameter portion before connector attachment.

36. The system of claim 30, wherein the electromagnetic shield of the coaxial connector comprises a mounting end of the coaxial connector that is adjacent to the interface, the mounting end being annular in shape and coplanar with a connection end of a coaxial transmission line of the coaxial connector, the coplanar mounting end comprising an annular mounting surface that interfaces to the annular pad of the mounting footprint during connector attachment, the connection end of the coaxial transmission line interfacing to the center pad during connector attachment, the coplanar mounting end providing electromagnetic shielding to the coaxial transmission line at the interface.

* * * * *

UNITED STATES PATENT AND TRADEMARK OFFICE

CERTIFICATE OF CORRECTION

PATENT NO. : 6,992,544 B2
APPLICATION NO. : 10/269710
DATED : January 31, 2006
INVENTOR(S) : Barnes et al.

It is certified that error appears in the above-identified patent and that said Letters Patent is hereby corrected as shown below:

Title page,
Item [56], References Cited, U.S. PATENT DOCUMENTS,
after "3,201,722 A" insert -- * --.
after "4,346,355" insert -- * --.
after "4,995,815" insert -- * --.
after "5,570,068" insert -- * --.
after "6,166,615" insert -- * --.
after "6,700,464" insert -- * --.

Column 15,
Line 58, delete "conector" and insert -- connector --.

Column 16,
Line 6, delete "comprises a footprint" before "portion for".
Line 27, delete "creatd" and insert -- created --.

Column 17,
Line 13, after "reducer" delete "accommodates the".
Line 39, delete "of" and insert -- of the --.
Line 51, delete "interace" and insert -- interface --.

Column 18,
Lines 6 and 15, delete "tranmission" and insert -- transmission --.
Line 60, delete "shop" and insert -- stop --.
Line 65, after "enclosing" insert -- the --.

Column 19,
Line 21, delete "circuit" and insert -- circuit, --.
Line 23, delete "transmssion" and insert -- transmission --.

UNITED STATES PATENT AND TRADEMARK OFFICE

CERTIFICATE OF CORRECTION

PATENT NO. : 6,992,544 B2
APPLICATION NO. : 10/269710
DATED : January 31, 2006
INVENTOR(S) : Barnes et al.

It is certified that error appears in the above-identified patent and that said Letters Patent is hereby corrected as shown below:

Column 20,
Line 4, delete "the," and insert -- the --.

Signed and Sealed this

Eleventh Day of July, 2006

JON W. DUDAS
*Director of the United States Patent and Trademark Office*